US005421767A

United States Patent [19]

Spears, Jr. et al.

[11] Patent Number: 5,421,767

[45] Date of Patent: Jun. 6, 1995

[54] MEDIA CONTROL VALVE

[75] Inventors: William E. Spears, Jr., Lawrenceville, N.J.; James D. Shank, Jr., Vestal, N.Y.

[73] Assignee: Church & Dwight Co., Inc., Princeton, N.J.

[21] Appl. No.: 161,530

[22] Filed: Dec. 6, 1993

[51] Int. Cl.[6] ..... B24C 7/00

[52] U.S. Cl. ..... 451/101; 451/75

[58] Field of Search ..... 51/438, 410; 137/385; 251/121, 63, 63.5, 297

[56] References Cited

U.S. PATENT DOCUMENTS

| | | | |
|---|---|---|---|
| 2,994,344 | 8/1961 | Kerley | 251/297 |
| 3,476,440 | 11/1969 | Schmidt et al. | 302/53 |
| 4,406,180 | 9/1983 | Naumec | 74/822 |
| 4,522,373 | 6/1985 | Shelbourn et al. | 251/297 |
| 4,534,139 | 8/1985 | Desjardins | 51/438 |
| 4,909,277 | 3/1990 | Vandiver | 137/493.7 |

*Primary Examiner*—Bruce M. Kisliuk
*Assistant Examiner*—Derris H. Banks
*Attorney, Agent, or Firm*—Charles B. Barris

[57] ABSTRACT

A media control valve used to dispense and meter an amount of abrasive media from a supply pot to a compressed air line for blast cleaning comprises a vertical discharge passage and an air flow tube communicating with the vertical discharge passage, a media control sleeve placed in an inclined bore in the valve body and disposed between the vertical discharge passage and air flow tube, the media control sleeve comprising a plurality of spaced orifices which allow communication between the vertical discharge passage and the air flow tube, the media control sleeve being rotatable in place within the valve body bore so as to present a different orifice in communication with the discharge passage.

19 Claims, 5 Drawing Sheets

MEDIA CONTROL VALVE

BACKGROUND OF THE INVENTION

The present invention is concerned with novel blast cleaning components, including a novel media valve to control the amount of abrasive media directed to the compressed air stream, a novel pressurization system which reduces the contact of moisture with the particulate abrasive contained in a media supply pot and a novel blast nozzle which reduces electric spark discharging during the blast cleaning operation.

Standard sand blasting equipment consists of a pressure vessel or supply pot to hold particles of a blasting medium such as sand, a source of compressed air connected to the supply pot via a conveying hose and a means of metering the blasting medium from the supply pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 10–20 pounds per minute. About 0.5 to 1 pound of sand are used typically with about 1.0 pound of air, thus yielding a ratio of 0.5 to 1.0.

When it is required to remove coatings such as paint or to clean relatively soft surfaces such as aluminum, magnesium, plastic composites and the like, or to avoid surface alteration of even hard materials such as stainless steel, less aggressive abrasives, including inorganic salts such as sodium chloride and sodium bicarbonate, can be used in place of sand in conventional sand blasting equipment. The media flow rate used for the less aggressive abrasives is substantially less than that used for sand, and has been determined to be from about 0.5 to about 10.0 pounds per minute, using similar equipment. The lower flow rates require a much lower media to air ratio, in the range of about 0.05 to 0.5.

However, difficulties are encountered in maintaining continuous flow at these low flow rates when conventional sand blasting equipment is employed. The fine particles of an abrasive media such as sodium bicarbonate are difficult to convey by pneumatic systems by their very nature. Further, the bicarbonate media particles tend to agglomerate upon exposure to a moisture-containing atmosphere, as is typical of the compressed air used in sand blasting. Flow aids such as hydrophobic silica have been added to the bicarbonate in an effort to improve the flow, but maintaining a substantially uniform flow of bicarbonate material to the blast nozzle has been difficult to achieve. Non-uniform flow of the blast media leads to erratic performance, which in turn results in increased cleaning time and even to damage of somewhat delicate surfaces.

Commonly assigned U.S. Pat. Nos. 5,081,799 and 5,083,402 disclose a modification of conventional blasting apparatus by providing a separate source of line air to the supply pot through a pressure regulator to provide a greater pressure in the supply pot than is provided to the conveying hose. This differential pressure is maintained by an orifice having a predetermined area and situated between the supply pot and the conveying hose. The orifice provides an exit for the blast media and a relatively small quantity of air from the supply pot to the conveying hose, and ultimately to the nozzle and finally the workpiece. The differential air pressure, typically operating between 1.0 and 5.0 psi with an orifice having an appropriate area, yields acceptable media flow rates in a controlled manner. The entire contents of U.S. Pat. Nos. 5,081,799 and 5,083,402 are herein incorporated by reference.

A media metering and dispensing valve which meters and dispenses the abrasive from the supply pot through the orifice and to the conveying hose carrying the compressed air stream typically operates automatically whenever the compressed air is applied to the blast hose to begin the abrasive blasting operation. The media valve for use in the afore-mentioned metering and dispensing process as disclosed in U.S. Pat. Nos. 5,081,799 and 5,083,402 is characterized as a Thompson valve and is described in detail in U.S. Pat. No. 3,476,440, the contents of which are herein incorporated by reference. The Thompson valve includes a metering valve stem which blocks the outlet of a discharge tube disposed between the supply pot and an air flow tube which is secured to and carries the compressed air to the conveying hose. When the blast nozzle is activated, the valve stem is lifted from the valve seat of the Thompson valve and allows a controlled amount of media to flow through the outlet of the discharge tube into the air flow tube. The valve as disclosed in U.S. Pat. No. 3,476,440 has been improved by placing the valve stem within a control sleeve which contains a plurality of orifices having different sizes, one of which can be placed in communication with the outlet of the discharge tube and the air flow tube. When the valve stem is seated within the valve body and closed, the orifice in the control sleeve is blocked such that media cannot flow from the discharge tube through the orifice in the media control sleeve and then into air flow tube. Upon operation of the blast nozzle, the valve stem is pulled away from the orifice to allow the media flow from the pot to the discharge tube, through the orifice and into the air flow tube.

The plurality of orifices provides another means of controlling the amount of media flowing from the supply pot into the compressed air stream and into the blast nozzle apparatus. Unfortunately, to change the orifice which is in alignment with the media discharge tube and the air flow tube or to clean out a plugged orifice in the Thompson valves now on the commercial market, it is required that the valve body holding the stem be taken apart, the valve sleeve taken out, rotated, placed back in its slot and the valve body then restructured. Obviously such disassembly and reassembly is cumbersome and certainly does not allow for efficient blast cleaning on the job site. Accordingly, it would be useful to provide a media control valve which can be more readily and easily changed to control the media flow from the supply pot to the air flow tube.

As briefly discussed above, moisture is often added to the media in the supply pot during pressurization. During pressurization of the supply pot, compressed air enters the media supply pot through a pop-up tube after the abrasive media has been fully loaded into the pot. Incoming air causes a pop-up valve slidably engaged in the pop-up tube to rise and seal off the media supply opening in the pot allowing pressurization of the pot and activation of the differential pressure media metering system described previously. Unfortunately, moisture accumulates in the air supply line to the supply pot and upon the initial pressurization of the media supply pot, the compressed air carries the collected pool of moisture up the pop-up tube and into the media pot moistening the media and causing portions of the particulate media to agglomerate. The agglomerated media is not readily free-flowing which often causes a non-uniform media flow from the pot. The problem of moisture is exacerbated since the initial air expands rapidly causing the air to cool which consequently causes precipitation of the trapped moisture from the air onto the particulate media. It would be worthwhile to provide a means to supply compressed air to the media supply pot for the differential pressure metering system which supply means would eliminate the problem of entrained moisture within the compressed air from leaving the pop-up tube and falling onto the particulate abrasive media in the supply pot.

Still another problem during blast cleaning often exists with the blast nozzle itself. The blast nozzles most used to convey the abrasive media such as sand, sodium bicarbonate, etc. are venturi-type nozzles which contain a converging inlet section, an orifice and an expanding outlet section which accelerates the blast media entrained in the compressed air stream to the outlet of the nozzle. If sand or other hard abrasive is utilized, the blast nozzles are often formed of a hard ceramic. A particularly useful ceramic is a reaction-bonded silicon nitride. Nozzles formed from this ceramic material are described in copending, commonly assigned PCT Application PCT/US93/09409, filed Oct. 7, 1993, the contents of which are herein incorporated by reference. The hard ceramic material which forms the nozzle is relatively brittle and is thus encapsulated in a resin such as a polyurethane protective jacket. Both the ceramic and resinous jacket are poor conductors of electricity. As the fast moving abrasive particles slide along the interior surfaces of the blast nozzle, static electricity is generated. The static electrical charges are commonly dissipated by bonding, i.e., electrically connecting the nozzle to the blast machine and grounding the blast machine to the workpiece. Bonding and grounding the blast nozzle provides an electrical path to dissipate the static charges to ground. Unfortunately, the ceramic nozzles being constructed of poor electrically conductive materials, are essentially electrically insulated from ground and accordingly, static electric charges accumulate on the nozzle and discharge periodically in the form of static electric sparks and nuisance shocks to the operator. These static electric sparks are undesirable as they can ignite flammable vapors, gas and dusts causing explosions.

Disclosed in afore-mentioned PCT/US93/09409 is a blast nozzle configured to accelerate the blast media, in particular, sodium bicarbonate, to speeds in excess of those generated in conventional blast nozzles. The combination of higher abrasive media speeds and nonconductible materials which form the blast nozzle amplifies the generation and accumulation of static electricity on the nozzle and consequently the electric discharge problem common in any air driven blasting system. Moreover, dry ambient air common in winter months produces even greater amounts of static charges. Accordingly, it would be worthwhile to form a high performance blast nozzle of a hard ceramic material and provide an efficient means for electrically grounding the nozzle to eliminate the build up of static electric charges and the disadvantageous sparking that results from such static charge accumulation.

SUMMARY OF THE INVENTION

The present invention is concerned with a novel and improved media control valve which dispenses and meters the flow of abrasive particulate media from the supply pot to the air flow tube which is secured to and communicates with the conveying hose which carries the compressed air and entrained abrasive media and directs same to the blast nozzle apparatus. The media control valve of this invention is particularly useful in the differential pressure metering system of U.S. Pat. Nos. 5,081,799 and 5,083,402 as described above as the novel metering valve offers additional control with respect to metering the flow of media but such valve can also be used with any system which meters the media from the supply pot. The media control valve includes a control sleeve which contains a plurality of orifices, one of which can be aligned to communicate with the discharge of the media from the supply pot and the air flow tube to dispense the media into the compressed air stream. The plurality of orifices having a different diameter allow enhanced control of the amount of media dispensed from the supply pot to the compressed air flow tube by allowing a change of orifice size. To control the metering of the abrasive media into the air flow tube, the control sleeve can be rotated while in place in the valve body to align a different orifice with the media discharge passage in communication with the supply pot and the compressed air flow tube. Alternative embodiments are provided to index the control sleeve such that an orifice is properly aligned upon rotation of the control sleeve. In one embodiment, the index means comprises a ball spring plunger placed in the valve body and exerted against the control sleeve and a series of detents spaced in the sleeve and aligned with each orifice so as to properly align the orifice with the media discharge passage from the supply pot and the air flow tube when the ball spring plunger fits within a detent in the sleeve. The control sleeve which contains the valve stem can be easily removed from the valve body in one piece for cleaning and replaced and locked in place in the valve body by means of a lock pin without disassembling the body of the valve. In the second embodiment, the index means comprises a plurality of grooves which are placed on the face of the bore which receives the control sleeve and which mate with a plurality of teeth on the control sleeve. The teeth are aligned with the orifices. To change orifices, the control sleeve is lifted to disengage the teeth from the grooves and rotated until the teeth and grooves are again aligned and the sleeve then dropped in place in the valve body.

The media control valve also includes a manually adjustable multi-port valve placed within the media discharge passage and which can close off the discharge passage from the supply pot, and allow compressed air to back clean the valve and direct debris out a clean-out port in the valve body.

In another aspect of the invention, a novel pop-up valve in the abrasive media supply pot is provided to close off the media inlet into the pot and which substantially eliminates the discharge of moisture into the supply pot and on the media during the initial pressurization of the supply pot such as used in the differential pressure metering system of previously mentioned U.S. Pat. No. 5,083,402. In this aspect of the invention, the pop-up valve stem fits and is slidable within a pop-up valve tube which is secured to the compressed air supply tube. The pop-up valve tube includes an insert which prevents air and accumulated moisture from passing between the circumferential edge of the pop-up valve tube and the pop-up valve stem. Moisture which contacts the insert falls back into the compressed air supply line which can be periodically drained. The insert in the pop-up valve tube includes a central orifice which limits the expansion of the compressed air entering the pot to reduce cooling of the expanding gas and prevent precipitation of entrapped moisture.

In still another aspect of the invention, the blast nozzles which are formed of poor electrically conductive ceramic materials can be provided with a conductive plating or coating film between the ceramic portion of the nozzle and the outer nonconductive resinous encapsulation coat. The conductive film can be connected to an electric pathway outside the nozzle to ground, thus, preventing the buildup of static electricity in the nozzle and preventing the periodic sparking.

DETAILED DESCRIPTION OF THE INVENTION

The invention can best be described by referring first to the preferred method of controlling the metering of the abrasive media into the compressed air stream using differential pressure as disclosed in U.S. Pat. No. 5,083,402. In order to feed fine particles of a material such as a bicarbonate abrasive having a mean particle size of from 50 to 1000 microns, preferably from about 200 to 300 microns, at a uniform rate, pressures within the supply pot, including the blast hose pressure, must be positive with respect to the nozzle. Pressures are typically in the range of about 20–125 psig.

Since the supply pot and the conveying hose operate at about the same pressure, the flow of blast media in conventional sand blasting equipment is controlled by gravity feed and a metering valve. It has been found, however, that the supply pot was under a small differential pressure with respect to the blast delivery hose pressure, which fluctuated between positive and negative. The result was that the flow rates of the blast media fluctuated also in response to the differential pressure changes. Accordingly, a differential pressure gauge has been installed between the delivery hose and the supply pot to monitor the differential pressure directly. The pressure can be closely controlled by means of a pressure regulator at any hose pressure from 10 to 125 psig or higher, depending on the supply air pressure. The invention disclosed in U.S. Pat. No. 5,083,402 eliminates the source of flow rate variation and also modifies conventional equipment to handle blast media at low flow rates of from about 0.5 to 10 pounds per minute, preferably up to about 5 pounds per minute.

Figure 1:
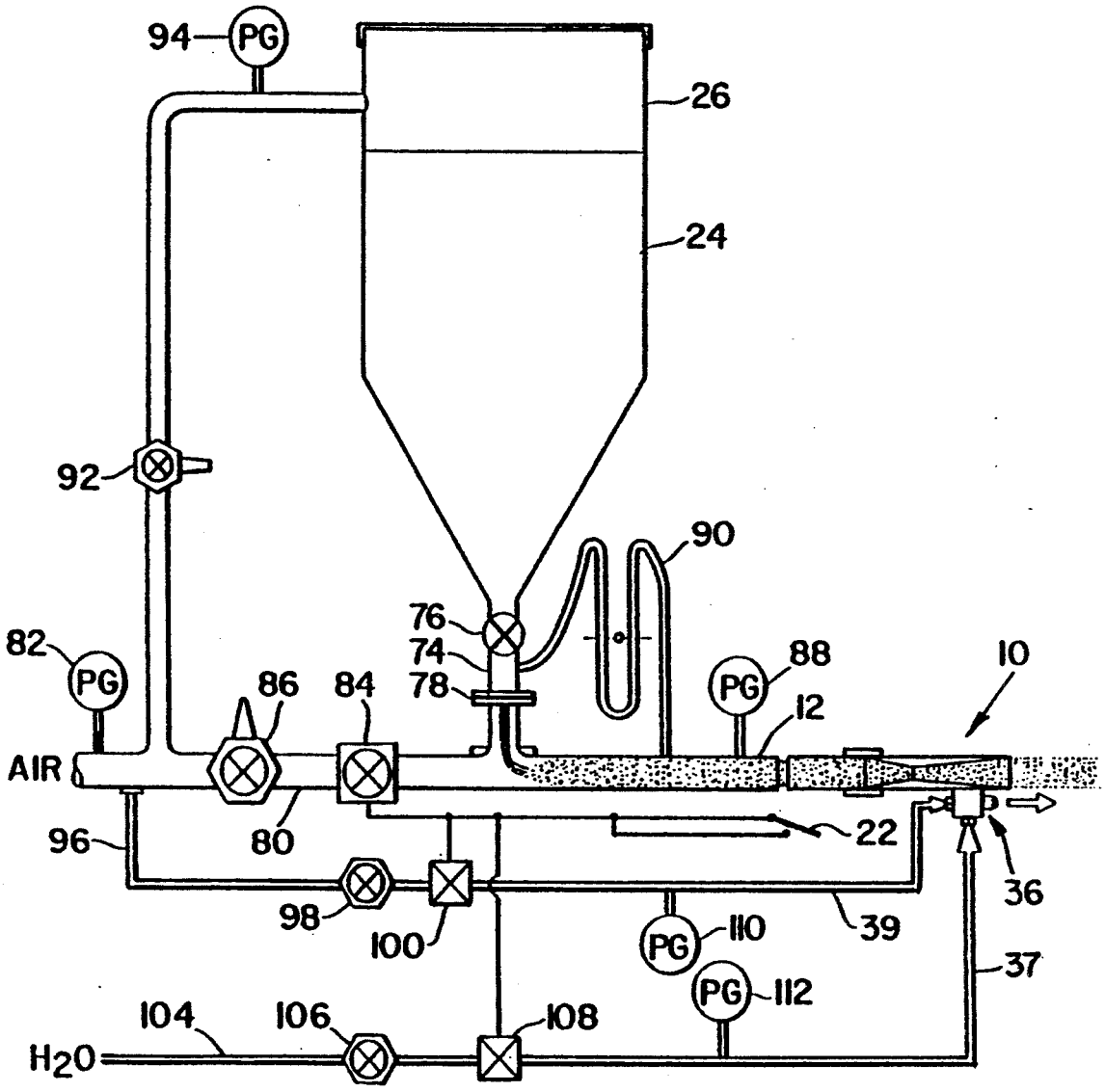
FIG. 1 is a schematic illustration of the differential pressure metering system useful with the media control valve of this invention.

The differential pressure metering system can be described by reference to FIG. 1. Although the blast media illustrated is sodium bicarbonate, other blast media such as potassium bicarbonate, ammonium bicarbonate, sodium chloride, sodium sulfate and other water-soluble salts are meant to be included herein. Referring to FIG. 1, the blast system includes supply pot 26 partially filled with blast media 24. The supply pot 26 suitably having a cavity of about 6 cubic feet, terminates in a media exit line 74 governed by a media control valve 76. The media control area can be further limited by an orifice plate 78 which further restricts the flow of the media 24 to the desired flow rate. A line 80 is connected to a source of pressurized air (not shown) which is monitored with an inlet monitor 82. Air valve 84 is a remotely operated on/off valve that activates the air flow to blast nozzle 10 and the opening and closing of the media control valve 76. Nozzle pressure regulator valve 86 regulates the nozzle pressure by means of a monitor 88 when the system is in operation. Nozzle pressure regulator valve 86 can maintain the desired nozzle pressure. The nozzle pressure monitor 88 enables a controlled pressure to be applied to the nozzle 10. The differential pressure gauge 90 monitors the pressure between the supply pot 26 and the supply hose 12. The pot pressure regulator 92, measured by gauge 94, is used to provide a pressure higher than the pressure in the conveying hose 12, thus allowing the differential pressure to be monitored by differential pressure gauge 90.

In operation, the blast media 24 is fed through media exit line 74 governed by the media control valve 76 to an orifice plate 78, which further regulates the flow of media to the compressed air line 80. The orifice openings can vary from about 1/16 to about ¼ inch diameter, or openings corresponding to the area provided by circular orifices of 1/16 to ¼ inch diameter. Preferably, the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig preferably about 2 to 4 psig between the media exit line 74 and the conveying hose 12 is maintained at all times. A source of compressed air is fed to the air line 80, regulated by the valves 84 and 86 to the desired air pressure and nozzle pressure, respectively, which preferably is between about 30 to about 150 psi. The pot pressure regulator 92 controls the pressure to the top of the supply pot 26, further ensuring a controlled and uniform flow of blast media 24. The manometer or other differential pressure gauge 90 measures the differential pressure, which is proportional to the amount of media flowing through the orifice 78. The blast media and compressed air are delivered to the nozzle 10 and ejected toward the workpiece at a uniform and controllable rate.

Optional equipment for protection of and cooling of the workpiece and, in particular, for the control of dust is provided by a water atomizer 36 which directs a spray of atomized water toward the work surface. A more detailed description of the water atomizer is disclosed in copending, commonly assigned U.S. application Ser. No. 958,552, filed Oct. 8, 1992, the contents of which are herein incorporated by reference. The operation of the water atomizer nozzle 36 is similar to that described for the blast nozzle 10 above. Thus, air typically from the same supply which feeds blast nozzle 10 is directed through line 96 and the pressure thereof controlled by pressure regulator 98. Hose 39 directs the pressurized air to the appropriate air inlet port in the nozzle body of the water atomizer 36. Valve 100 is a on/off valve which is activated by the spring loaded deadman valve 22 which is controlled by the operator. Water for the water atomizer nozzle 36 is directed from a supply (not shown) and passed through line 104. The pressure is controlled by pressure regulator valve 106. Water through hose 37 is passed to a water inlet port of the nozzle body of water atomizer 36. On/off valve 108 again is controlled by deadman switch 22. Pressure gauges 110 and 112 indicate to the users the pressures in lines 96 and 104, respectively. All of the on/off valves 84, 100 and 108 are controlled by the operator through the deadman switch 22 and, thus, all flow of air, abrasive media and water to blast nozzle 10 and the water atomizer 36 can be activated and cut off by the spring activated switch which is typically in the form of a hand-held trigger adjacent the blast nozzle.

Figure 2:
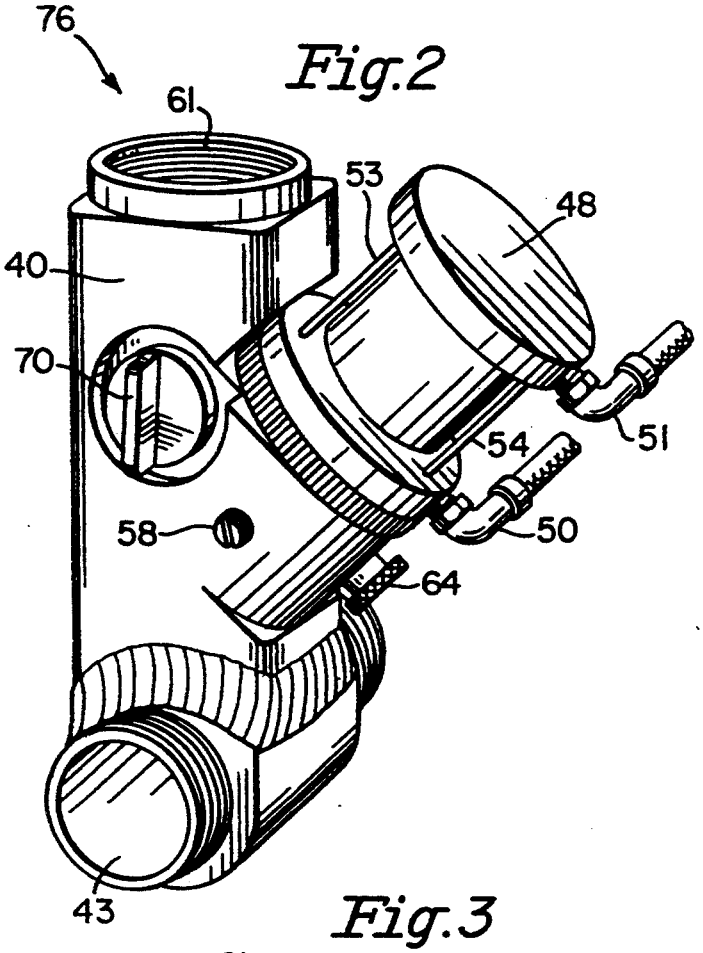
FIG. 2 is a perspective view of the media control valve of this invention.
Figure 3:
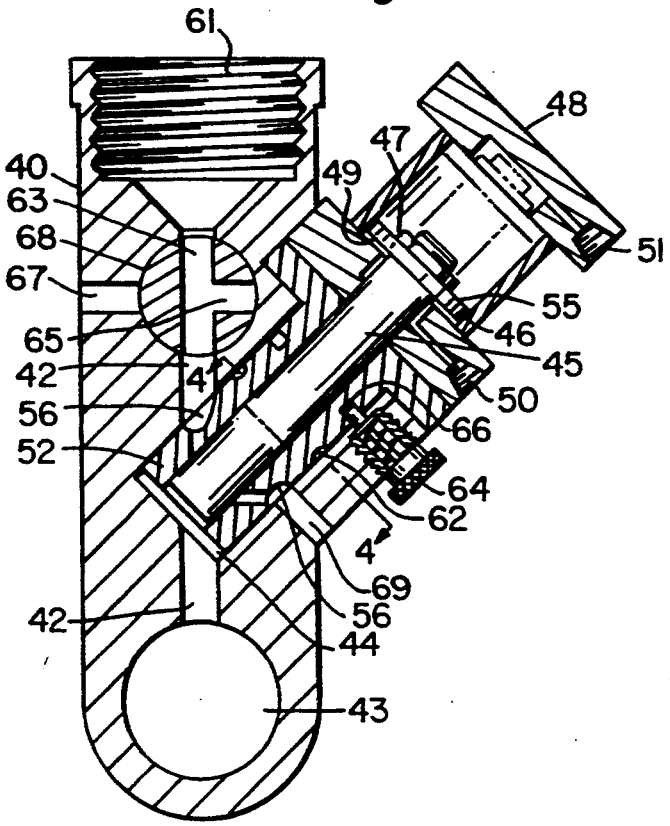
FIG. 3 is a cross-section of the media control valve of the invention.

The novel media control valve 76 of this invention includes orifice 78 and is illustrated in detail in FIGS. 2 and 3. Valve 76 includes a valve body 40. A substantially vertical connector (not shown) can be connected with valve body 40 to communicate with the media outlet thereabove within the supply pot 26, see FIG. 7. The connector extends down and joins with inlet 61 of a media passage within valve body 40 and which is shown as vertical discharge tube 42 within valve body 40. Discharge tube 42 communicates with a downstream horizontal air flow tube 43 also formed as part of valve body 40 in the preferred form of the invention. The air flow tube 43 is disposed substantially perpendicular to the vertical discharge tube 42 and communicates therewith, except for when a valve stem 45 is positioned to close the valve and prevent media flow therethrough. Valve stem 45 is placed within a bore 44 contained in valve body 40. Bore 44 is preferably disposed at an acute angle from vertical or is inclined with respect to the discharge tube 42. The amount of angle is not critical and can be from about 20° to 90° from vertical. Valve stem 45 is movable within bore 44 to close discharge tube 42 and completely seal off and prevent any of the abrasive or air pressure within the pot 26 from passing through the air flow tube 43.

A piston 46 is connected to, or is formed integrally with valve stem 45. Piston 46 can be threaded onto valve stem 45 and secured in place by lock nut 47. Piston 46 is placed in sealing engagement with the inside surface of pneumatic chamber 48 which is separate from valve body 40. The lower surface 49 of piston 46 is in communication with air pressure supplied from the air pressure source (not shown) feeding air flow tube 43 by means of a connecting pressure supply tube 50. Accordingly, compressed air applied to air flow tube 43 is also applied to the lower surface 49 of piston 46 to move piston 46 and attached valve stem 45 upward and out of discharge tube 42. Valve stem 45 can be returned to the closed position when the air pressure on the lower surface 49 of piston 46 is reduced or eliminated and compressed air is provided via valve supply tube 51 to the top surface 55 of piston 46 in chamber 48 to lower valve stem 45.

Preferably, valve stem 45 does not act to meter the amount of abrasive media flowing through discharge tube 42 into air flow tube 43. Instead, valve stem 45 is an on-off valve which when retracted will allow free passage of the media through discharge tube 42 into air flow tube 43 and when closed will stop all passage of the media therethrough. Valve stem 45 is slidable in a media control sleeve 52 which is placed within bore 44. Media control sleeve 52 is secured to pneumatic chamber 48 by a pair of screws 53 and 54. Media control sleeve 52 contains a plurality of spaced orifices 56 of varying diameter and which can be placed into communication with discharge tube 42 and air flow tube 43 to allow passage of the media therethrough when valve stem 45 is in the open position and displaced from the discharge tube 42. Orifices 56 are the equivalent of orifice 78 as shown in the differential pressure media metering system as shown in FIG. 1.

Figure 4:
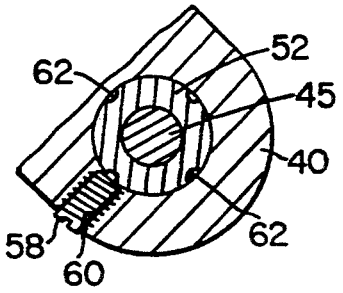
FIG. 4 is a cross-section of the media control valve of FIG. 3 taken along line 4—4.

The media control valve 76 of this invention is improved over prior art valves in that the media control sleeve 52 can be rotated while in place within bore 44 of valve body 40 so as to place one of the different orifices 56 in communication with discharge tube 42 and air flow tube 43. In prior art devices, the valve body 40 had to be disassembled, the control sleeve removed entirely from the valve body, and rotated to align the desired orifice with the discharge tube and then returned to the valve body which was then reassembled. In this invention, control sleeve 52 is manually rotatable in place within bore 44 and an index means is provided to align an orifice 56 with discharge tube 42 and to indicate to the user that the proper alignment has been made. Alternative index means are shown respectively in FIGS. 4 and (5 and 6). In the embodiment shown in FIG. 4, a ball-spring plunger 58 is situated within hole 60 in valve body 40 and extends partially into bore 44. The spring is biased toward bore 44. Spaced around media control sleeve 52 are a series of detents 62 which are aligned with the various orifices 56 such that when the ball-spring plunger 58 contacts a detent 62, one of the orifices 56 is aligned within discharge tube 42 and allows communication from discharge tube 42 to air flow tube 43 and consequently passage of the media therethrough. Manual rotation of sleeve 52 such as via chamber 48 at a torque to overcome the bias of the spring 58 releases the ball-spring plunger 58 from a detent 62 to continue rotation of sleeve 52. When ball-spring plunger 58 again enters a detent 62 this indicates that another of the orifices is in the proper alignment to allow media flow therethrough. By this manner, the media control sleeve does not need to be removed from valve body 40 to change orifice size and thus the proper metering of the media through the valve can be controlled by simply rotating in place the media control sleeve 52. As an example, the media control sleeve 52 can contain four-orifices having, but not limited to, a size of 0.125, 0,156, 0.187, and 0.209, inch in diameter. The exact size of the orifices is not critical to the invention and the listed sizes are for illustrative purposes only.

Figure 5:
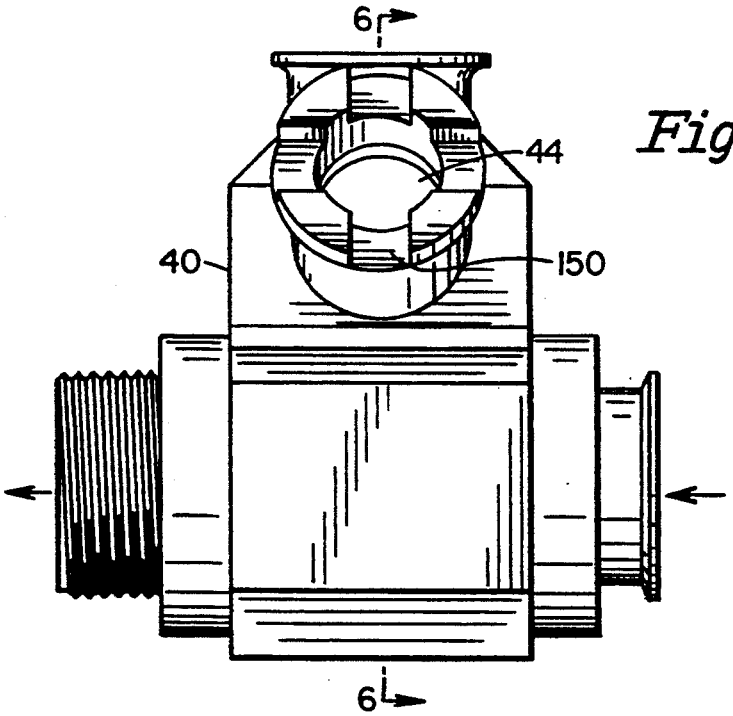
FIG. 5 is a perspective view of an alternative media control valve of this invention.
Figure 6:
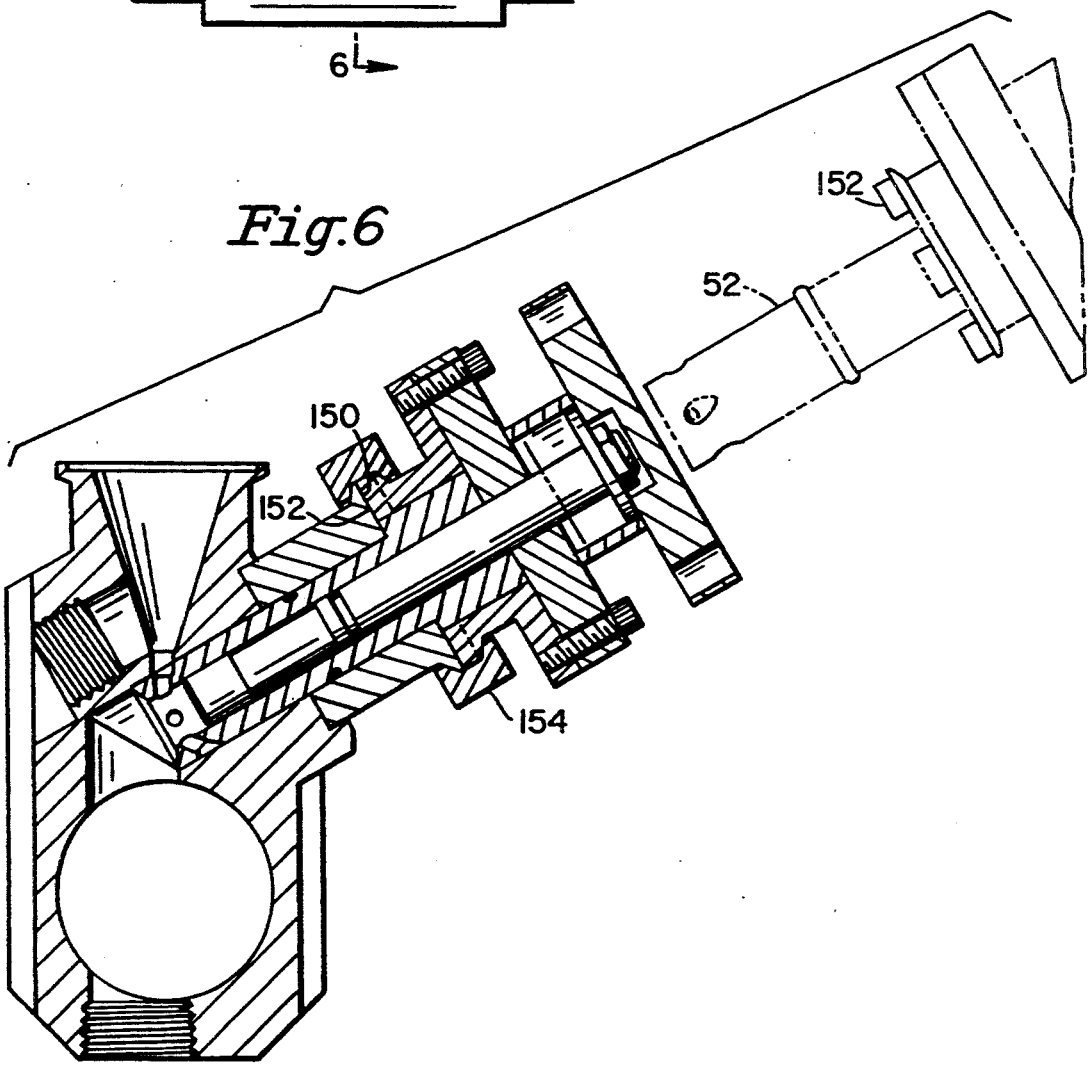
FIG. 6 is a cross-section view of the media control valve of FIG. 5 and showing in dotted line the removal of the media control sleeve.

The second embodiment for the index means to properly align the orifices 56 in vertical discharge tube 42 is shown in FIGS. 5 and 6. In this embodiment, valve body 40 contains at the face of bore 44 a plurality of spaced grooves 150 which can be mated with a plurality of spaced teeth 152 spaced around the circumferential surface of control sleeve 52. The orifices 56 are aligned with teeth 152 such that when teeth 152 are mated within grooves 150 an orifice 56 is in proper alignment within discharge tube 42. To change the orifice 56 which is in alignment with discharge tube 42, the control sleeve 52 which is slidable within bore 44 is lifted enough to disengage teeth 152 from groove 150, the control sleeve rotated so that the teeth 152 and groove 150 are again matched and the control sleeve then dropped into place to mate the teeth 152 with groove 150 where upon a different orifice is placed in alignment with discharge tube 42. Again, it is not necessary that the control sleeve be removed completely from bore 44 and that there be required any disassembly of the valve body 40.

Another important aspect of the invention is that the media control sleeve 52 can be removed from the valve body for cleaning without any disassembling of the valve body 40. Since the media control sleeve 52 is secured to pneumatic chamber 48 and valve stem 45 is also secured within chamber 48 and fits within the sleeve 52, the whole assembly comprising chamber 48, media control sleeve 52, valve stem 45 and piston 46 can be slidably removed in one piece from bore 44 of valve body 40. Alternative means to lock and unlock the sleeve assembly within bore 44 are provided. As shown in FIG. 3, a lock-pin 64 is provided to engage circumferential groove 66 in media control sleeve 52 and when engaged therein locks the control sleeve 52 in place within valve body 40. Rotation of control sleeve 52 is not prevented as groove 66 moves relative to lock-pin 64. Alternatively, as shown in FIG. 6, a clamp 154 attached to the exterior of valve body 40 secures sleeve 52 thereto. Again, there is no need to disassemble the valve body or the media control sleeve to remove same from the valve body to allow cleaning of the assembly.

Media control valve 76 also contains a multi-orifice ball or plug valve 68 which is placed intermediate inlet 61 of discharge tube 42 and the media control sleeve 52 and can be rotated manually via handle 70 to index the desired orifice or passageway therethrough. The valve 68 includes a diametrically placed passage 63 and a radially directed passage 65 which communicates with the center of diametric passage 63. In operation, when abrasive media is to be entrained within the compressed air stream, the valve 68 is turned so that diametric passage 63 is disposed vertically and communicates with the inlet 61 of discharge tube 42 and the lower portion of discharge tube 42 to allow media flow from inlet 61 through passage 63 in valve 68 and into the lower portion of discharge tube 42, through one of the orifices 56 in media control sleeve 52 and then into the air flow tube 43. Valve 76 also includes a means to clean out the discharge tube 42. In the clean out operation, valve 68 can be rotated so that the diametric passage 63 no longer communicates with the inlet 61 of discharge tube 42 but instead, is disposed horizontally and placed in communication with a clean out exit port 67 placed in valve body 40. Radial passage 65 is disposed vertically and placed in communication with the lower part of discharge tube 42. To clean discharge tube 42, valve stem 45 is disengaged from discharge tube 42 by action of pneumatic piston 46, compressed air is either passed up through air flow tube 43 or through clean out inlet port 69 which communicates with bore 44 and the interior of sleeve 52 to allow back-cleaning of the discharge tube. Any debris is discharged through outlet port 67 via radial passage 65 and diametric passage 63.

In the use or operation of the media valve 76 of this invention in combination with a supply pot 26, pot 26 is filled, or partially filled with, abrasive. After the abrasive is within the pot 26, it is pulled or is otherwise moved to the location for the blast cleaning operation. Supply pot 26 is then connected to a suitable source of compressed air. The compressed air or gas pressurizes the pot 26 and can also be used to supply the air pressure to the air flow tube 43 and air supply tube 50 of valve 76. Thus, pot 26 is pressurized and the valve 76 is automatically opened by displacement of valve stem 45 from discharge tube 42 substantially simultaneously. This results in a pressurized flow of the abrasive downwardly through the vertical discharge tube 42, through one of orifices 56 in control sleeve 52 and into the flow tube 43. The pressure within the flow tube 43 acts to force the abrasive outwardly to the discharge connection where one or more abrasive blasting hoses with suitable nozzles are connected, as will be well understood.

Figure 7:
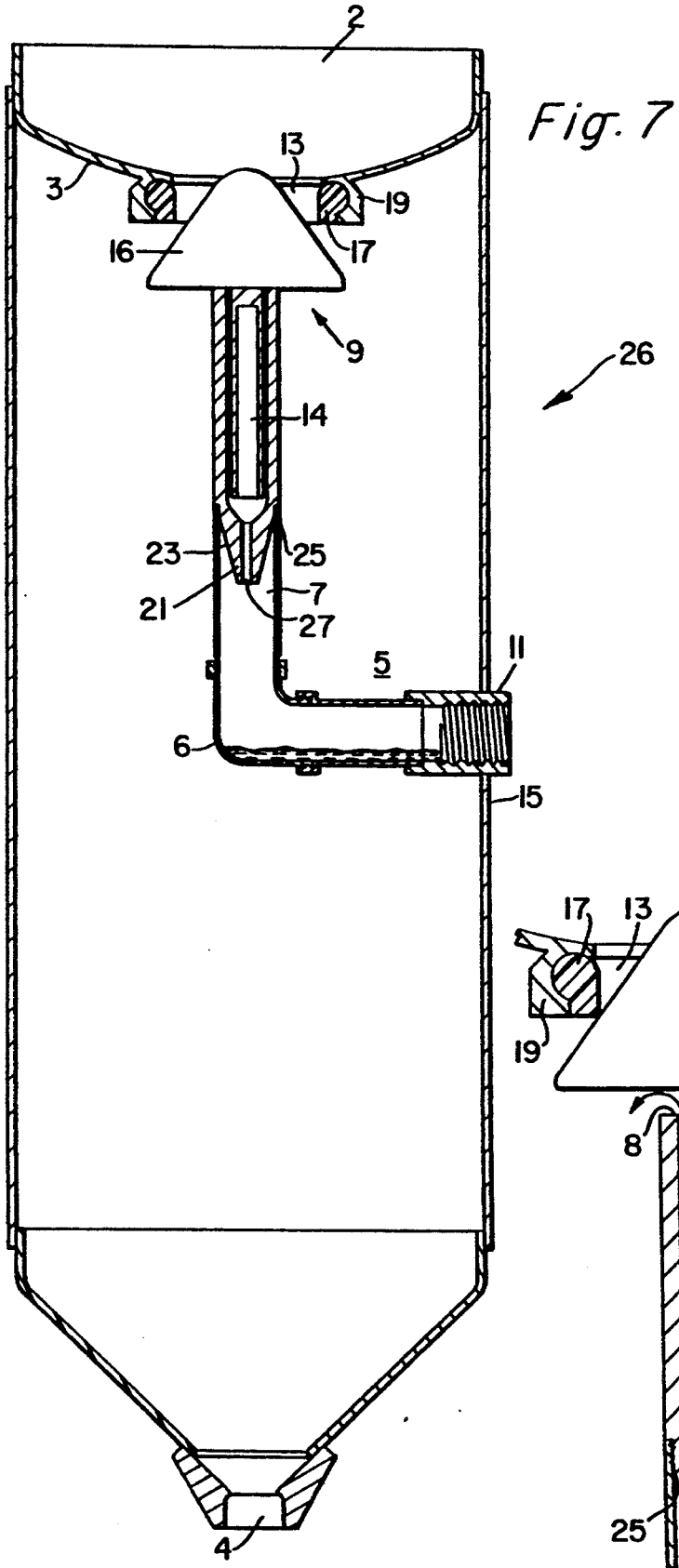
FIG. 7 is a cross-sectional view of the media supply pot of this invention.

In FIG. 7, reference numeral 26 designates generally the novel supply pot of this invention capable of holding an abrasive and dispensing same. Supply pot 26 is adapted to be filled or partially filled, with, sodium bicarbonate, sand or other abrasive. Supply pot 26 can be adapted to be transported to the point of use, at which point the pot is pressurized and serves as the dispenser for the abrasive.

Considering the invention more in detail, supply pot 26 is made of steel or other suitable rigid material and is capable of being pressurized. Normally, the pot 26 is a pressure vessel made in accordance with the American Society for Mechanical Engineers Code. Pot 26 has a loading area 2 at the upper end thereof. A closure cap or cover (not shown) is optional and should be removably mounted therewith. Loading area 2 includes a downwardly sloping floor 3 secured to the inside surface of pot 26. Floor 3 slopes to a center inlet opening 13 whereby the abrasive media particles are dispensed from loading area 2 through opening 13 and into pot 26. Floor 3 acts as a lid for the interior of pot 26. A cover can be installed to prevent foreign matter or moisture from entering pot 26 through loading area 2.

A media discharge or outlet 4 is provided at the bottom of the pressure vessel or pot 26 for the discharge and metering of the bicarbonate or other abrasive from the pot 26 through a metering valve. Although not shown in FIG. 7, media outlet 4 has a media control valve mounted therewith, which valve is more fully explained in connection with FIGS. 2–6. The bottom of pot 26 slopes downward and is of substantially conical shape, the apex of which contains discharge outlet 4.

When the pot 26 has been filled with abrasive, pot 26 may then be pressurized with air. To accomplish such pressurizing, a gas inlet pipe 11 extends through sidewall 15 of pot 26 and is welded thereto so that no air pressure escapes through sidewall 15 around pipe 11. Pipe 11 is connected to any source of compressed air (not shown). The compressed air stream is preferably regulated by means of pressure regulator 92 (FIG. 1). Within the interior of pot 26, a supply pipe 5 is secured to inlet pipe 11. In the center of pot 26, pipe 5 bends upward at elbow 6 and communicates with a valve tube 7 threaded onto elbow 6, and directed upwardly into pot 26. The upper end 8 of valve tube 7 is disposed near the upper end of pot 26 so that an air pressure is developed above the abrasive contained in pot 26. As more fully shown in FIG. 8, slidable within valve tube 7 is pop-up valve 9 containing a valve stem 14 and a valve stopper 16 which can snugly fit within media inlet opening 13 so as to prevent the escape of air through opening 13. When compressed air is supplied to pipe 5, the air passes through valve tube 7 and against valve stem 14 which is slidable upwardly with valve stopper 16 to seal the media opening 13. Valve stopper 16 fits against valve gasket 17 which surrounds opening 13 and rests within gasket support 19. Gasket support 19 is secured to the underside of floor 3. Between the inside wall of valve tube 7 and the outside surface of valve stem 14 is a small annular space 20 approximately ⅛ inch wide through which the air escapes once pop-up valve 9 is unseated from the top 8 of valve tube 7.

Previous to this invention, moisture which had sat within pipe 5 was blown into the pot 26 through valve tube 7 by the compressed air. The moisture typically traveled along the circumferential edge of the valve tube 7 in view of the differing densities between the compressed air stream and water and the centrifugal forces caused by the compressed air travelling through pipe elbow 6. The rapid expansion of the air as it initially entered tank 26 caused the compressed air stream to cool resulting in precipitation of entrapped moisture into the pot 26 and onto the abrasive media particles. The moisture tended to agglomerate the abrasive particles and often resulted in non-uniform metering of the abrasive through the media outlet 4 and through the downstream media control valve.

Figure 8:
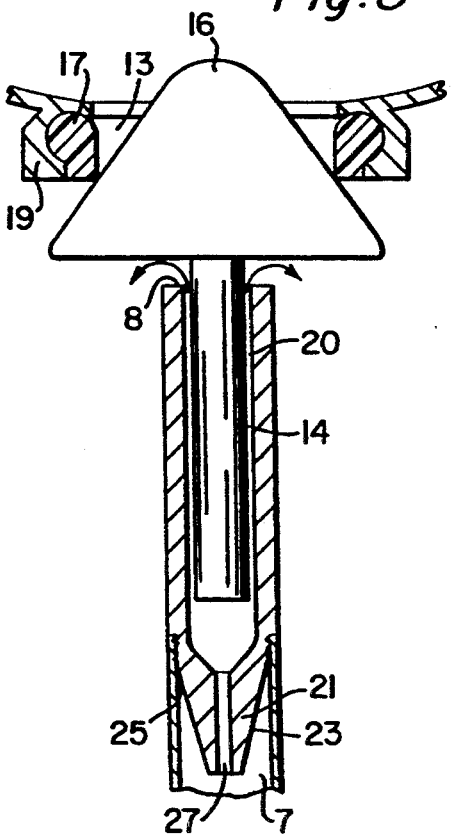
FIG. 8 is a cross-section view of the pop-up valve in FIG. 7 in the open position to allow pressurization of the supply pot.

In accordance with the present invention, the valve tube 7 has been reconfigured to include a moisture trap so as to prevent moisture from entering pot 26 during the initial pressurization thereof and to prevent the precipitation of moisture which is entrapped in the compressed air stream which enters pot 26. Thus, as shown in FIGS. 7 and 8, the moisture trap comprises a downwardly tapering cone 21 which sits within valve tube 7 below valve stem 14 of pop-up valve 9 when valve stopper 16 is seated on end 8 of valve tube 7. Cone 21 includes tapered side surface 23 which extends from the downwardly pointing apex to contact the inside walls of valve tube 7 at location 25. Thus, moisture which is entrained by the compressed air stream and traveling along the inside circumferential edge of valve tube 7 will be stopped at the point 25 where surface 23 contacts the inside edge of valve tube 7 and such moisture will fall back down into pipe 5. The compressed air from pipe 5 and valve tube 7 enters pot 26 through a central 5 narrow passage 27 extending from the apex of cone 21 completely therethrough and opening into valve tube 7 below the seated valve stem 14. By restricting the amount of air which is directed to pot 26 by imposition of passage 27, pressurization and expansion of air in supply pot 26 is slowed considerably. For example, fill time without the moisture trap is about 2 seconds while fill time through passage 27 is about 15–20 seconds. By slowing the expansion of air, the air is not so rapidly cooled and thus, entrapped moisture in the air is not readily precipitated into the pot and onto the abrasive. A drain (not shown) can be attached to inlet pipe 11 to remove entrapped moisture which accumulates in pipe 5. Preferably, the compressed air line 5 is a 1¼ inch supply pipe and the central passage 27 has a diameter of 3/16 of an inch. The annular space 20 between the valve stem 14 and pop-up tube 7 is approximately ⅛ of an inch to allow air flow into pot 26.

It has now been found that optimal productivity for blast cleaning a surface with a softer, less dense blast media such as sodium bicarbonate can be achieved by a venturi-type blast nozzle properly configured. Such a high performance nozzle is disclosed in aforementioned PCT/US93/09409. As disclosed therein, it has been found that optimal productivity can be achieved if the outlet length, that being the length of the venturi-type nozzle immediately downstream of the orifice (throat) to the outlet of the nozzle is approximately 20 times the diameter of the orifice. Thus, it has been found that an outlet length which is 18 to 24 times the orifice diameter provides optimal productivity. At outlet lengths below the range just cited, productivity is adversely affected. At lengths above the range, productivity is no longer improved or may be adversely affected. Along with the outlet length, optimal productivity is achieved if the outlet diameter is approximately 1.5 times the orifice diameter. Deviations of more than 10% below this parameter adversely affect productivity. Thus, the outlet diameter should be at least 1.35 times the orifice diameter. Deviations above 1.65 times the orifice diameter do not show benefits at media flow rates typically used to blast with sodium bicarbonate, i.e., 2–4 lbs./min. At higher flow rates, larger nozzle outlets may show productivity improvements.

With softer and friable blast media, passage through the converging inlet section of the venturi-type blast nozzle often degrades the particles of the media, creating particles of smaller mass and often causing turbulent flow in the inlet section thereby reducing the velocity of the particles as they travel through the blast nozzle. The loss of mass and velocity reduces the force of the particle on the targeted surface and, thus, can reduce productivity of the nozzle. Thus, the converging inlet section of the nozzle should converge at a relatively minor angle, typically from between about 5° to 15° from horizontal, preferably, approximately 10°. To further eliminate turbulent flow, the diameter of the inlet should be approximately equivalent to the inside diameter of the blast hose which supplies the blast media to the nozzle. Preferably, the inlet diameter should not deviate more than approximately 25% plus or minus from the inlet diameter of the supply hose. The longitudinal length of the orifice is optimum at lengths about equivalent to the orifice diameter. Larger orifice lengths have not been found to yield any significant improvement in productivity.

While the nozzle parameters previously described above have been optimized for improving blast cleaning with a soft media such as sodium bicarbonate, the formation of blast nozzles from a hard ceramic allow such nozzles to be used for blast cleaning with harder, more dense substances either added with the softer abrasive or as the sole abrasive agent. It is believed that the parameter for nozzle outlet length as described above will improve productivity of blast cleaning using the harder, more dense abrasive media even though the exact ratios of nozzle length to orifice diameter, outlet diameter to orifice diameter, etc. as described above may not yield the most optimum productivity with these abrasives.

The parameters, as above described, define a nozzle having a circular cross-section of specified orifice and outlet areas and angle of divergence in the outlet section. Accordingly, the dimensions of a nozzle of any cross-section can be calculated based on the described ratios.

Figure 9:
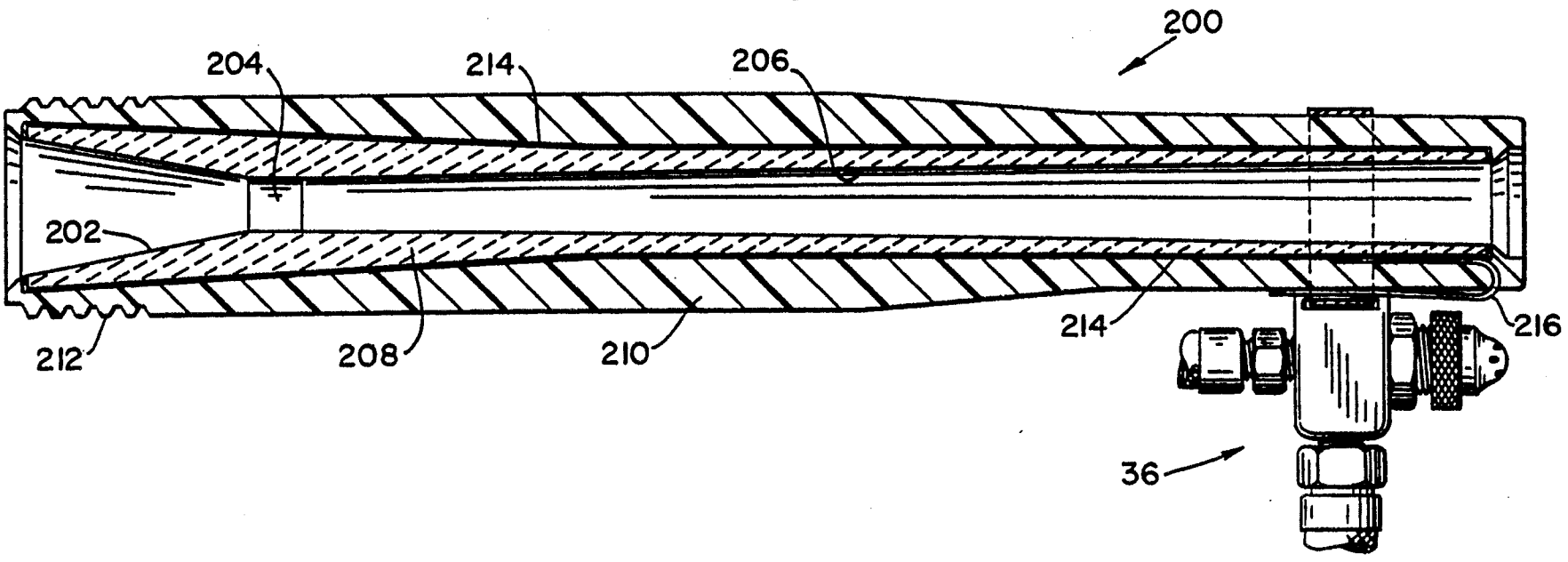
FIG. 9 is a cross-sectional view showing the blast nozzle of this invention capable of reducing the discharge of electric sparks.

While stainless steel nozzles can be used to direct a soft media such as sodium bicarbonate to a targeted surface, for certain applications, it is useful to include a minor amount of a hard abrasive with the softer bicarbonate abrasive. Thus, in U.S. application Ser. No. 07/854,204, filed Mar. 20, 1992, the present assignee has developed a blast media which comprises a major amount of a soft abrasive such as sodium bicarbonate with a minor amount of a hard abrasive such as aluminum oxide to remove contaminants from steel surfaces. The hard abrasive allows a profile to be placed on the targeted surface which can then be repainted. Unfortunately, the hard abrasive even though present in minor amounts tends to erode the internal surfaces of a stainless steel nozzle. Accordingly, the present invention is directed to a blast nozzle formed of a hard ceramic substance having the parameters described above. The interior surface of the blast nozzle of this invention can be formed from tungsten carbide, silicon carbide, boron carbide, silicon nitride, etc. or any other hard ceramic material which is abrasion resistant especially to hard blast media such as sand, aluminum oxide, and other ceramic blast media. Such a nozzle is shown in FIG. 9. As shown therein, blast nozzle 200 includes a hollow inlet converging section 202, a venturi orifice 204 and a hollow diverging outlet section 206. The hollow portions are formed by a ceramic liner 208 which can be any of the materials described above. Surrounding the ceramic liner is a plastic encapsulating coat 210 so as to prevent breakage of the ceramic liner and, thus, provides improved impact strength to the blast nozzle 200. The encapsulating coat 210 can be formed from any high impact plastic and as such the particular encapsulating coat is not critical to the invention. A preferred encapsulating coat is a polyurethane resin. At the inlet end of blast nozzle 200, the encapsulating coat 210 is provided with external threads 212 for threading onto a blast hose by means of a supply hose holder (not shown) and the like.

A particularly preferred blast nozzle is formed from reaction bonded silicon nitride. Briefly, the silicon nitride nozzle is made from a packing mixture consisting of silicon nitride powder and a densification aid selected from a group of materials consisting of magnesium oxide, yttrium oxide, cerium oxide and zirconium oxide. The processes for forming reaction bonded silicon nitride articles are disclosed in U.S. Pat. Nos. 4,235,857; 4,285,895; 4,356,136; 4,377,542; and 4,388,414, all assigned to Ford Motor Co and incorporated herein by reference. A particular useful nozzle is formed from a reaction bonded silicon nitride under the tradename Ceralloy 147-31E by Ceradyne, Inc., Costa Mesa, Calif.

During the blast-cleaning operation, the abrasive particles are in contact and slide along the interior surfaces of the blast nozzle. Accordingly, a substantial buildup of static electric charge is accumulated on the nozzle surfaces. This charge buildup is exacerbated when using the high performance nozzle as immediately described above since the velocity of the media is increased to speeds not heretofore accomplished. Blasting in the dry winter months also exacerbates the problem of the static electric charge buildup. Periodically, the static electric charges will discharge from the nozzle in the form of static electric sparks and nuisance shocks to the operator. These sparks are undesirable as they can ignite flammable vapors, gases and even some dusts. Unfortunately, the high performance nozzle formed of a ceramic such as silicon nitride is relatively nonconducting. The encapsulating resinous jacket added to protect the ceramic nozzle insulates the nozzle from ground and, thus, the static charges cannot be bled off to a ground so as to prevent the accumulation of static charge and the periodic discharging in the form of static electric sparks. Thus, it is necessary in some manner to ground the nozzle to prevent the accumulation of static electric charge. It is important that the grounding materials completely cover the nozzle so as to prevent localized charge buildup and discharge. In accordance with the present invention and as shown in FIG. 9, the ceramic nozzle 208 is provided with an electrically conductive coating or plating film 214. Film 214 can be a metallic material such as chrome, nickel, copper or other metal or conductive metallic material. Electrically conductive film 214 is bonded to ground via a wire 216 which is in contact with electrically conductive film 214 and which is brought through the encapsulation coat 210 to the outside of nozzle 200. Wire 216 can be attached to any conductive portion of the nozzle apparatus such as the water atomizer 36 and then to ground via the atomized water supply line 37. In this way, static electric charges which accumulate on the nozzle can be dissipated from the nozzle and conducted through the conductive film 214 through wire 216 to any external ground on nozzle 200. Alternatively, the film 214 may be substituted with an electrically conductive wire mesh or like configuration which can ground the substantially entire surface of the nozzle without leaving localized areas where static charges can accumulate to the point where spark discharges occur.

What is claimed is:

1. A media control valve for dispensing and metering particulate abrasive media from a supply pot to a compressed air stream comprising: a valve body having a substantially vertical discharge passage, an air flow tube below said discharge passage and communicating therewith, a bore within said valve body separate from said discharge passage and communicating therewith, said bore containing a hollow, cylindrical media control sleeve, a portion of said sleeve being disposed within said vertical discharge passage, said media control sleeve containing a plurality of spaced orifices one of which can be aligned in said vertical discharge passage so as to provide communication between said discharge passage and said air flow tube, said media control sleeve being rotatable in place within said bore to change the orifice in communication with said discharge passage and said air flow tube.

2. The media control valve of claim 1 further containing a valve stem slidable within said media control sleeve, at least a portion of said valve stem capable of being disposed between said vertical discharge passage and said air flow tube to prevent flow of media through said sleeve.

3. The media control valve of claim 2 wherein said valve stem is movable within said media control sleeve by means of a pneumatic element which is attached to said media control sleeve, said media control sleeve, valve stem and pneumatic control element capable of being removed from said bore as a single assembly.

4. The media control valve of claim 3 wherein said pneumatic element comprises a piston placed on one end of said valve stem, said piston being placed in a sealed chamber, said chamber including means to apply air pressure on the underside of said piston to lift said valve stem out of said vertical discharge passage and means to apply air pressure onto the upper surface of said piston to close said valve stem whereby a portion of said valve stem is disposed within said vertical discharge passage.

5. The media control valve of claim 1 further including index means capable of providing proper alignment of said orifice in said vertical discharge passage upon the rotation of said media control sleeve within said bore.

6. The media control valve of claim 5 wherein said index means comprises a ball spring plunger disposed within said bore and biased against said media control sleeve, said media control sleeve containing a plurality of detents aligned with said ball spring plunger and said orifices such that when said ball spring plunger is fitted within a detent, one of said orifices is in communication with said vertical discharge passage and said air flow tube.

7. The media control valve of claim 1 wherein said air flow tube is disposed substantially perpendicular to said vertical discharge passage.

8. The media control valve of claim 3 further including a movable lock pin contained in said valve body and movable into and out of engagement with said media control sleeve to lock said media control sleeve within said bore and to allow removal of said media control sleeve from said bore, respectively.

9. The media control valve of claim 8 wherein said lock pin engages a groove placed around the exterior of said sleeve so as to allow rotation of said sleeve when said lock pin is in engagement with said groove.

10. The media control valve of claim 5 wherein said index means comprises a plurality of spaced grooves on the face of said valve body around said bore, said media control sleeve containing a plurality of spaced teeth which can mate with said grooves on said valve body face when said media control sleeve is positioned within in said bore, said teeth being aligned with said orifices such that when said teeth are mated with said grooves, one of said orifices is in communication with said vertical discharge passage and said air flow tube.

11. The media control valve of claim 3 including a clamp which is placed on the exterior of said valve body and said media control sleeve to lock said media control sleeve within said bore.

12. The media control valve of claim 1 further including a multi-orifice valve disposed within said vertical discharge passage, said multi-orifice valve including a diametrically placed passage and a radially placed passage in communication with said diametrically placed passage, said multi-orifice valve being rotatable to a first position to allow abrasive media to flow downwardly through said diametrically placed passage and into said vertical discharge passage and to a second position wherein said media cannot flow downwardly through said diametrically placed passage.

13. The media control valve of claim 12 wherein in said second position said radially disposed passage is in communication with said vertical discharge passage and said diametrically placed passage is in communication with an outlet port in said valve body to allow backcleaning of said valve.

14. The media control valve of claim 12 wherein said multi-orifice valve is rotatable to a third position wherein said diametrically placed passage allows abrasive media to flow downwardly therethrough into said vertical discharge passage and said radically placed passage is in communication with an outlet port in said valve body as a vent.

15. The media control valve of claim 1 wherein said bore is inclined at an angle from acute to perpendicular relative to said vertical discharge passage.

16. The media control valve of claim 15 wherein said bore is inclined at an acute angle relative to said vertical discharge passage.

17. The media control valve of claim 1 wherein said media control sleeve is rotatable in place within said bore without disassembly of said valve body.

18. A media control valve for dispensing and metering particulate abrasive media from a supply pot to a compressed air stream comprising: a valve body having a substantially vertical discharge passage, an air flow tube below said discharge passage and communicating therewith, a bore within said valve body separate from said discharge passage and communicating therewith, said bore containing a media control sleeve, a portion of said sleeve being disposed within said vertical discharge passage, said media control sleeve containing a plurality of spaced orifices one of which can be aligned in said vertical discharge passage so as to provide communication between said discharge passage and said air flow tube, said media control sleeve being manually rotatable within said bore from the exterior of said valve body to change the orifice in communication with said discharge passage and said air flow tube.

19. A media control valve for dispensing and metering particulate abrasive media from a supply pot to a compressed air stream comprising: a valve body having a substantially vertical discharge passage, an air flow tube below said discharge passage and communicating therewith, a bore within said valve body separate from said discharge passage and communicating therewith, said bore containing a media control sleeve, a portion of said sleeve being disposed within said vertical discharge passage, said media control sleeve containing at least one orifice which can be aligned in said vertical discharge passage so as to provide communication between said discharge passage and said air flow tube, said valve further containing a valve stem slidable within said media control sleeve, at least a portion of said valve stem capable of being disposed between said vertical discharge passage and said air flow tube to prevent flow of media through said sleeve, said valve stem being movable within said media control sleeve by means of a pneumatic element which is attached to said media control sleeve, said media control sleeve, valve stem and pneumatic control element capable of being removed from said bore as a single assembly.

* * * * *